US010448464B2

(12) United States Patent
Wittmann et al.

(10) Patent No.: US 10,448,464 B2
(45) Date of Patent: Oct. 15, 2019

(54) MICROWAVE OVEN OR A MULTIFUNCTIONAL OVEN WITH MICROWAVE HEATING FUNCTION

(71) Applicant: Electrolux Home Products Corporation N. V., Brussels (BE)

(72) Inventors: Michael Wittmann, Rothenburg ob der Tauber (DE); Trevor Specht, Rothenburg ob der Tauber (DE); Tobias Schutz, Rothenburg ob der Tauber (DE); Benjamin Himmelein, Rothenburg ob der Tauber (DE)

(73) Assignee: Electrolux Home Products Corporation N.V., Brussels (BE)

( * ) Notice: Subject to any disclaimer, the term of this patent is extended or adjusted under 35 U.S.C. 154(b) by 730 days.

(21) Appl. No.: 14/647,897

(22) PCT Filed: Oct. 23, 2013

(86) PCT No.: PCT/EP2013/072149
§ 371 (c)(1),
(2) Date: May 28, 2015

(87) PCT Pub. No.: WO2014/114371
PCT Pub. Date: Jul. 31, 2014

(65) Prior Publication Data

US 2015/0327336 A1 Nov. 12, 2015

(30) Foreign Application Priority Data

Jan. 25, 2013 (EP) ..... 13152704

(51) Int. Cl.
*H05B 6/76* (2006.01)
*F24C 15/02* (2006.01)
(Continued)

(52) U.S. Cl.
CPC ..... *H05B 6/6414* (2013.01); *F24C 15/08* (2013.01); *H05B 6/6402* (2013.01);
(Continued)

(58) Field of Classification Search
CPC .... H05B 6/6405; H05B 6/6426; H05B 6/763; H05B 6/6414; H05B 6/6402; F24C 15/08
(Continued)

(56) References Cited

U.S. PATENT DOCUMENTS 2,958,754 A * 11/1960 Hahn ..... H05B 6/763 174/382
3,029,805 A * 4/1962 Scott ..... F24C 15/021 126/190

(Continued)

OTHER PUBLICATIONS

International Search Report for PCT/EP2013/072149, dated Jan. 3, 2014, 2 pages.

(Continued)

*Primary Examiner* — Dana Ross
*Assistant Examiner* — Lawrence H Samuels
(74) *Attorney, Agent, or Firm* — Pearne & Gordon LLP

(57) ABSTRACT

A microwave oven or multifunctional oven with microwave heating function. The oven includes a cavity with an open front side and a front frame enclosing at least partially a front portion of the cavity. The cavity and the front frame include metal sheet. The front frame is connected to the cavity by fixing elements. A gap is formed between the cavity and the front frame. The gap encloses at least partially the front portion of the cavity and the front frame encloses the gap. The oven includes a door covering the open front side and the gap in a closed state of the door. The gap is at least partially filled by a gasket at least part of which includes one or more materials having low heat conductivity, (Continued)

Figure 1:
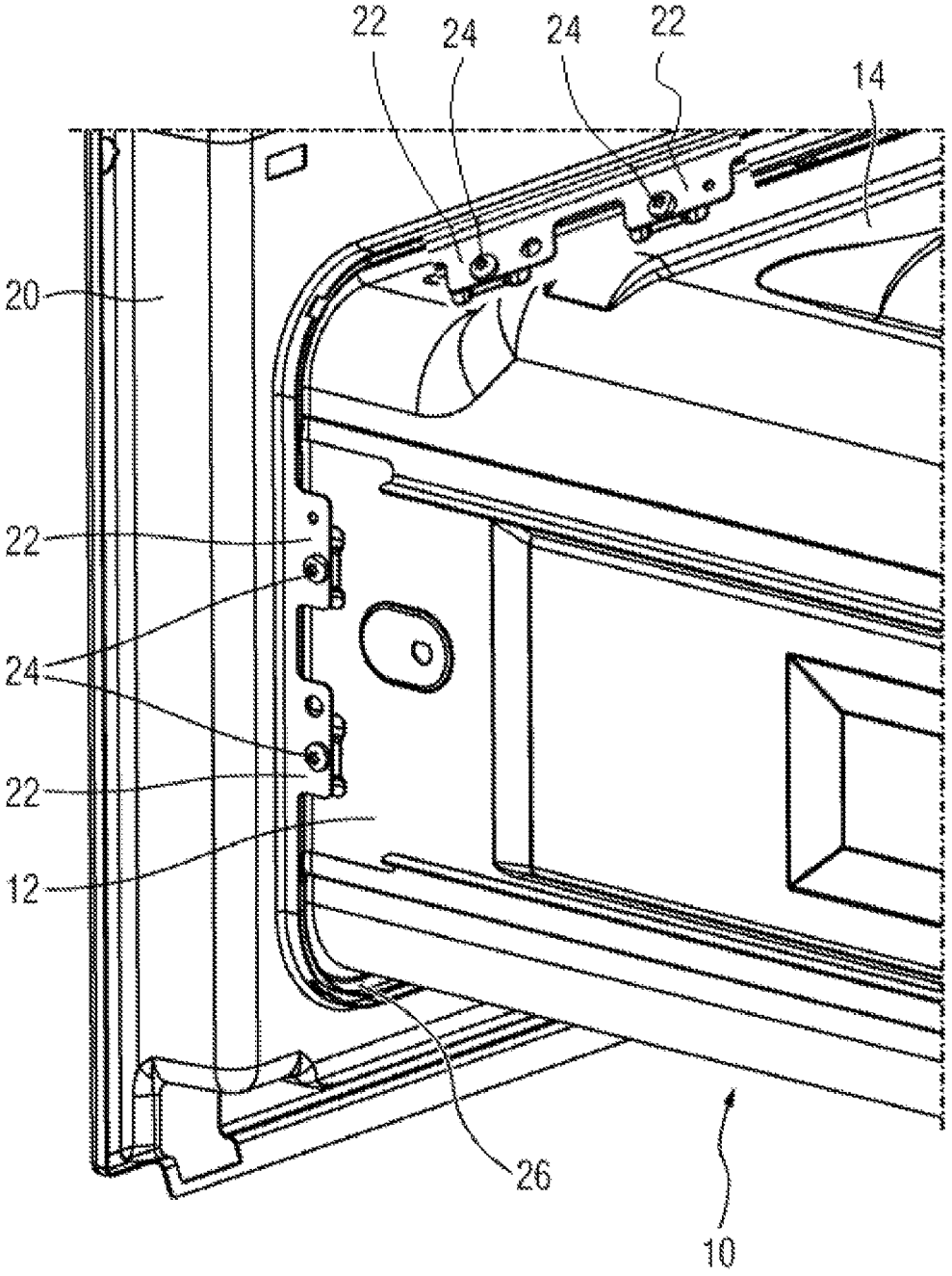

so that the front frame is thermally decoupled from the cavity by the part of the gasket or the gap.

17 Claims, 3 Drawing Sheets

(51) Int. Cl.
*H05B 6/64* (2006.01)
*F24C 15/08* (2006.01)

(52) U.S. Cl.
CPC ..... *H05B 6/6405* (2013.01); *H05B 6/6426* (2013.01); *H05B 6/763* (2013.01)

(58) Field of Classification Search
USPC ..... 219/680, 741, 756
See application file for complete search history.

(56) References Cited

U.S. PATENT DOCUMENTS 3,666,904 A * 5/1972 Krajewski ..... H05B 6/6417 126/190
3,678,238 A * 7/1972 Yasuoka ..... H05B 6/763 219/741
3,731,035 A * 5/1973 Jarvis ..... H05B 6/6414 126/190
3,812,316 A * 5/1974 Milburn ..... F24C 15/021 174/358
3,846,608 A * 11/1974 Valles ..... H05B 6/763 174/358
4,059,742 A * 11/1977 Baron ..... H05B 6/763 219/685
4,146,768 A * 3/1979 Orke ..... F24C 7/02 126/200
4,166,207 A * 8/1979 Burke ..... H05B 6/763 174/377
4,563,559 A * 1/1986 Enami ..... H05B 6/6426 219/738
5,194,691 A * 3/1993 McIlwraith ..... H02B 1/16 174/354
6,359,270 B1 * 3/2002 Bridson ..... G06Q 10/107 219/679
7,022,957 B2 * 4/2006 Bakanowski ..... H05B 6/763 219/741
7,339,146 B2 * 3/2008 Aisenbrey ..... H05B 6/66 219/761
9,347,671 B2 * 5/2016 Bringe ..... F24C 7/00
2004/0245246 A1 * 12/2004 Bakanowski ..... H05B 6/763 219/741
2006/0118554 A1 * 6/2006 Aisenbrey ..... H05B 6/66 219/761
2006/0278629 A1 12/2006 Gagas et al.
2007/0039953 A1 * 2/2007 Kim ..... H05B 6/763 219/742
2007/0095822 A1 5/2007 Wiseman et al.
2010/0140251 A1 * 6/2010 Shei ..... A21B 3/00 219/430

OTHER PUBLICATIONS

Examination Report issued in corresponding Australian Patent Application No. 2013375426 dated Feb. 28, 2018, 3 pages.
Examination Report issued in corresponding Australian Patent Application No. 2013375426 dated Feb. 14, 2018, 5 pages.
Examination Report issued in corresponding Australian Patent Application No. 2013375426 dated Dec. 20, 2017, 3 pages.

* cited by examiner

MICROWAVE OVEN OR A MULTIFUNCTIONAL OVEN WITH MICROWAVE HEATING FUNCTION

The present invention relates to a microwave oven or a multifunctional oven with a microwave heating function. In particular, the present invention relates to a multifunctional oven with microwave heating function and at least one further heating function.

In a microwave oven or a multifunctional oven with a microwave heating function a front frame encloses a front opening of the oven cavity. Usually, a gasket is pressed against the front frame in a closed state of an oven door. Such a gasket provides only steam tightness.

At standard microwave ovens the front frame is welded to the oven cavity or is a part of said oven cavity. This constellation avoids microwave leakage at the door. However, heat conduction occurs from the oven cavity via the front frame out of the oven. This becomes particularly relevant, if the oven has further heating functions beside the microwave heating function.

It is an object of the present invention to provide a microwave oven or a multifunctional oven with a microwave heating function, wherein the heat conduction via the front frame is reduced.

The present invention relates to a microwave oven or a multifunctional oven with microwave heating function, wherein

- the oven comprises an oven cavity with an open front side,
- the oven comprises a front frame enclosing at least partially a front portion of the oven cavity,
- the oven cavity and the front frame comprise metal sheet in each case,
- the front frame is connected to the oven cavity by a number of fixing elements,
- a gap is formed between the oven cavity and the front frame,
- the gap encloses at least partially the front portion of the oven cavity and the front frame encloses the gap in turn,
- the gap is at least partially filled by a gasket,
- the oven comprises an oven door covering the open front side of the oven cavity and the gap in a closed state of said oven door, and
- at least a part of the gasket is made of one or more materials having low heat conductivity, so that the front frame is thermally decoupled from the oven cavity by said part of the gasket and/or by the gap.

An important aspect of the present invention refers to the gap between the oven cavity and the front frame and to the gasket that is arranged inside said gap. The front frame is thermally decoupled from the cavity by the gap on the one hand and the gasket having reduced heat conductivity on the other hand. The gap and the gasket avoid heat conduction from the oven cavity via the front frame out of the oven.

The gap between the oven cavity and the front frame can have any suitable width that allows substantially to reach the aforementioned aim of the invention. For example, the gap can have a width in a range from about 0.1 mm to about 10 mm, in particular in a range from about 1 mm to about 5 mm, preferably a width between 2 mm and 3 mm, for example a width of 2.5 mm.

In particular, the fixing elements are screws and/or rivets.

Further, the front frame comprises a number of lugs aligning at the side wall, top wall and/or bottom wall of the oven cavity, in particular wherein said lugs align with lugs arranged on at least one of side wall, top wall and/or bottom wall, preferably wherein said lugs align with lugs arranged on each one of side wall, top wall and/or bottom wall.

Preferably, at least a part of the gasket comprises at least one elastic material. The elastic material allows a compensation of tolerance between the front frame and the oven door. In general, the whole gasket may be made of one or more elastic materials. However, at least that portion of the gasket arranged between the front frame and the inner side of the oven door is preferably elastic.

In particular, at least a part of the gasket comprises at least one electrically conductive material. The electrically conductive material prevents an infiltration of microwaves into the gap between the front frame and the oven cavity. In general, the whole gasket may be electrically conductive. However, at least that portion of the gasket arranged within the gap between the front frame and the oven cavity preferably comprises electrically conductive material.

According to a special embodiment of the present invention a front portion and a rear portion of the gasket comprise different materials, wherein the front portion comprises at least one electrically non-conductive material, while the rear portion comprises at least one electrically conductive material.

For example, the gasket comprises one or more silicone materials.

Further, the rear portion of the gasket comprises at least one silicone material containing small metallic particles mixed into said silicone materials. The metallic particles are very small and spaced from each other so far that the metallic particles do not form a thermal bridge between the cavity and front frame on the one hand. The equal distribution of the metallic particles causes a similar function as a metal grid.

Preferably, at least a part of the rear portion of the gasket fills the gap.

In particular, the gasket is formed as a single-piece part.

Moreover, the oven door may comprise a wave choke system extending in an outer portion of said oven door, so that the wave choke system is arranged in front of the gap, if the oven door is in the closed state.

For example, the rear portion of the gasket has an L-shaped cross section. In this case, the L-shaped rear portion of the gasket encloses at least partially a rim at the front side of the oven cavity.

At last, the oven is a multifunctional oven with a microwave heating function and at least one further heating function.

Novel and inventive features of the present invention are set forth in the appended claims.

Figure 2:
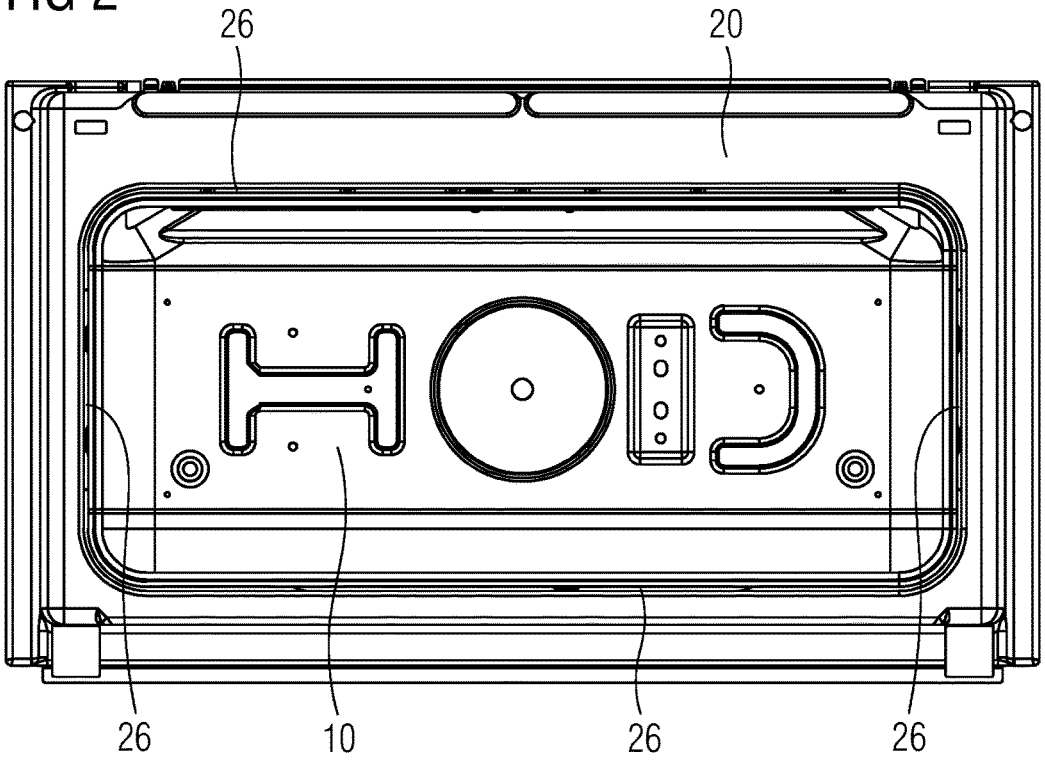
Figure 3:
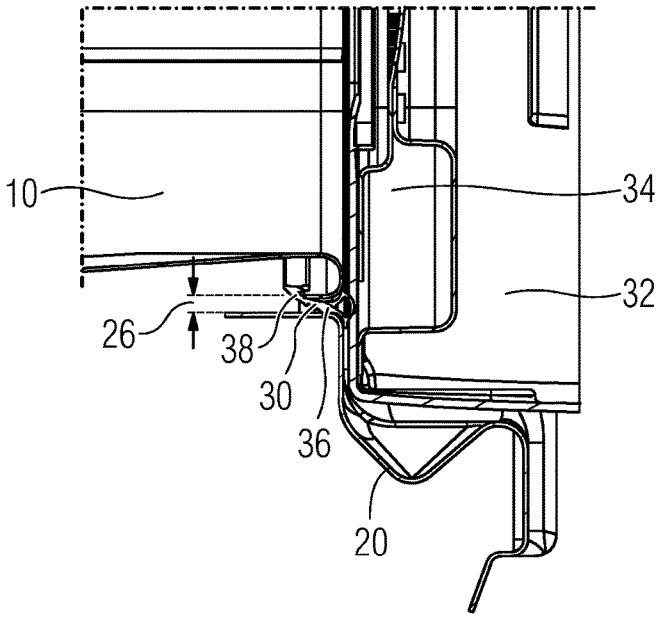
Figure 4:
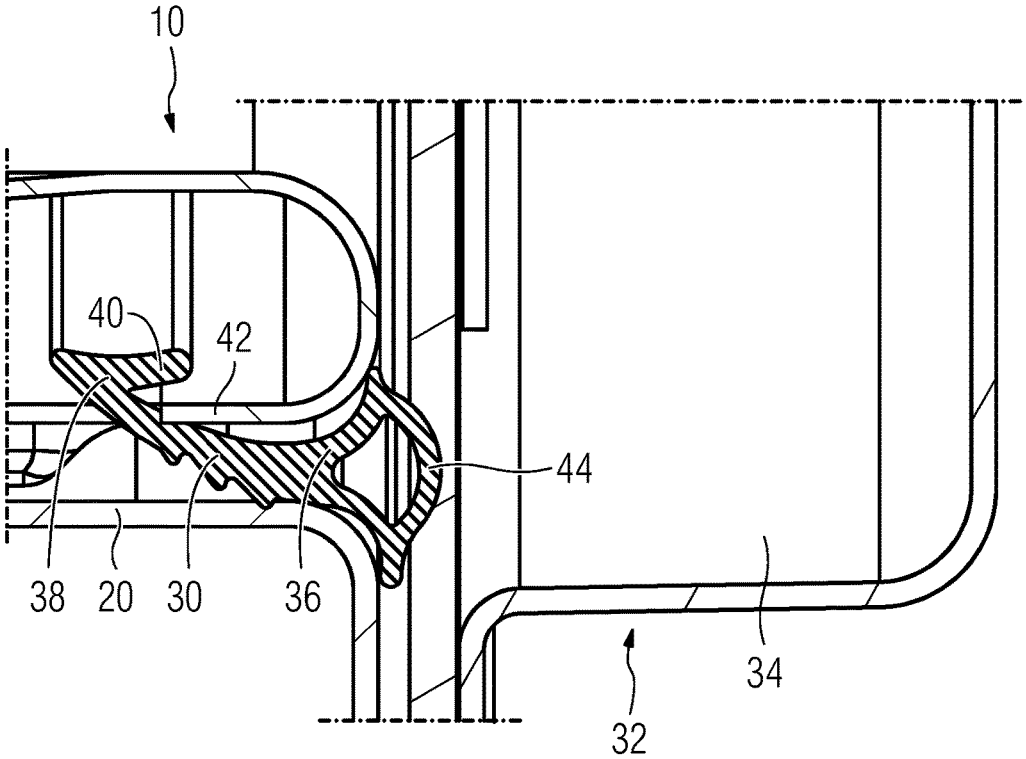

The present invention will be described in further detail with reference to the drawings, in which FIG. 1 illustrates a rear perspective view of an oven cavity and a front frame of a microwave oven or a multifunctional oven with microwave heating function according to a preferred embodiment of the present invention, FIG. 2 illustrates a front view of the oven cavity and the front frame of the microwave oven or the multifunctional oven with microwave heating function according to the preferred embodiment of the present invention, FIG. 3 illustrates a sectional side view of the oven cavity and the front frame of the microwave oven or the multifunctional oven with microwave heating function according to the preferred embodiment of the present invention, and FIG. 4 illustrates a detailed sectional side view of a gasket between the oven cavity and the front frame of the microwave oven or the multifunctional oven with microwave heating function according to the preferred embodiment of the present invention.

FIG. 1 illustrates a rear perspective view of an oven cavity 10 and a front frame 20 of a microwave oven or a multifunctional oven with microwave heating function according to a preferred embodiment of the present invention. The oven cavity 10 and the front frame 20 are made of sheet metal.

The oven cavity 10 includes two side walls 12, a top wall 14, a bottom wall 18 and a rear wall 18. Thus, the oven cavity 10 is a casing with an open front side. The front frame 20 is attached at the oven cavity 10 and encloses a front opening of said oven cavity 10.

The front frame 20 is fixed at the oven cavity 10 by screws 24. In this example, the front frame 20 includes lugs 22, wherein the screws 24 penetrates said lugs 22 and corresponding lugs arranged on a flange surrounding the front open side of the oven cavity 10. Said flange is formed integrally to the oven cavity 10 and is bent such, that the lugs arranged on said flange extend parallel to the lugs 22. By means of this construction, the thermal flow from the oven cavity 10 into the front frame 20 is small.

There is a gap 26 between the front frame 20 and the oven cavity 10. The gap 26 encloses the oven cavity 10. In this example, the gap 26 has a width of about 2.5 mm. The gap 26 allows a thermal insulation between the oven cavity 10 and the front frame 20. There is no heat transfer from the oven cavity 10 to the front frame 20.

The gap 26 is filled by a gasket 30. The gasket 30 is made of a thermal insulating material. The gasket 30 allows a sealing between the oven cavity 10 and the front frame 20 on the one hand and prevents the heat transfer from the oven cavity 10 to the front frame 20 on the other hand. The only heat transferring elements are the screws 24. However, the number of screws between the front frame 20 and the oven cavity 10 is very low.

Further, the gasket 30 comprises small metallic particles at least in that part arranged within the gap 26 between the front frame 20 and the oven cavity 10. The metallic particles are very small and spaced from each other so far that the metallic particles do not form a thermal bridge between the cavity and front frame on the one hand. The equal distribution of the metallic particles causes a similar function as a metal grid. Thus, the metallic particles prevent an infiltration of microwaves into the gap 26 between the front frame 20 and the oven cavity 10.

FIG. 2 illustrates a front view of the oven cavity 10 and the front frame 20 of the microwave oven or the multifunctional oven with microwave heating function according to the preferred embodiment of the present invention. FIG. 2 clarifies that the front frame 20 encloses the front opening of said oven cavity 10. Further, FIG. 2 shows the gap 26 between the front frame 20 and the oven cavity 10. The gap 26 encloses completely a front portion of the oven cavity 10.

FIG. 3 illustrates a sectional side view of the oven cavity 10 and the front frame 20 of the microwave oven or the multifunctional oven with microwave heating function according to the preferred embodiment of the present invention.

The front frame 20 encloses the front opening of the oven cavity 10. The gap 26 extends between the front frame 20 and the oven cavity 10. In other words, the gap 26 encloses the front portion of the oven cavity 10, while the front frame 20 encloses said gap 26 in turn.

An oven door 32 closes the front opening of the oven cavity 10. The front frame 20 encloses a rear portion of a circumferential surface of the oven door 32. Further, the front frame 20 encloses an outer portion of a rear side of the oven door 32. The oven door 32 comprises a wave choke system 34 arranged inside said oven door 32. The wave choke system 34 extends circumferentially in an outer portion of the oven door 32. In a closed state of the oven door 32, the wave choke system 34 is arranged in front of the gap 26 and extends in parallel to said gap 26. The gap 26 is filled by the gasket 30. The gasket 30 is made of the thermal insulating material. The gasket 30 allows a sealing between the oven cavity 10 and the front frame 20 on the one hand and prevents the heat transfer from the oven cavity 10 to the front frame 20 on the other hand. In particular, the gasket 30 is made of a silicone material.

In this example, the gasket 30 includes two components 36 and 38 made of different materials. The gasket 30 includes a front portion 36 and a rear portion 38. The front portion 36 of the gasket 30 has substantially a triangular cross section and fills the gap 26 between the oven cavity 10 and the front frame 20. The rear portion 38 of the gasket 30 has an L-shaped cross section enclosing partially a rim 42 at the front side of the oven cavity 10. A rear side of the oven door 32 is aligned at a front side 44 of the front portion 36 of the gasket 30. The front side 44 of the front portion 36 works as a steam gasket. In particular, said front side 44 of the front portion 36 prevents the leakage of steam out of the oven cavity 10 between the oven door 32 and the front frame 20. Moreover, the front side 44 of the front portion 36 prevents the penetration of steam into the casing of the microwave oven between the oven cavity 10 and the front frame 20.

In this example, the front portion 36 of the gasket 30 comprises one or more electrically non-conductive materials, while the rear portion 38 of the gasket 30 comprises one or more electrically conductive material. In general, the whole gasket 30 may be electrically conductive. At least a portion of the gasket 30 arranged within the gap 26 must be made of or comprises electrically conductive material. It has been found that the front portion 36 of the gasket 30 does not require an electrically conductive component, if the wave choke system 34 is inside the oven door 32 and in front of the gap 26.

The wave choke system 34 is already sufficient to stop leakage via the oven door 32.

For example, the gasket 30 comprises different silicone materials. The rear portion 38 of the gasket 30 may be made of one or more silicone materials containing small metallic particles mixed into said silicone materials.

The gasket 30 provides tightness for microwaves to the inner oven. Further, the gasket 30 provides tightness regarding steam and other substances occurring in the oven. Moreover, the gasket 30 allows a compensation of tolerances of the oven door 32 and the front frame 20.

FIG. 4 illustrates a detailed sectional side view of the gasket 30 between the oven cavity 10 and the front frame 20 of the microwave oven or the multifunctional oven with microwave heating function according to the preferred embodiment of the present invention.

The gasket 30 is made of the thermal insulating material and fills the gap 26. The gasket 30 allows the sealing between the oven cavity 10 and the front frame 20 and prevents the heat transfer from the oven cavity 10 to the front frame 20. Additionally, the gasket 30 prevents the infiltration of microwaves into the casing of the microwave oven in order to avoid a disruption of electronic circuits inside said microwave oven.

The gasket 30 according to the preferred embodiment includes the front portion 36 and the rear portion 38. The front portion 36 of the gasket 30 has substantially the triangular cross section and fills the front portion of the gap 26 between the oven cavity 10 and the front frame 20. The rear portion 38 of the gasket 30 has an L-shaped cross section and includes a hook 40 at its rear end. The hook 40 prevents that the gasket 30 slips out of the gap 26, if the gasket 30 adheres to the inner side of the oven door 32. For example, the adhesion of the gasket 30 to the inner side of the oven door 32 may be caused by dirt on the gasket 30 and/or the inner side of the oven door 32. The rear portion 38 of the gasket 30 encloses partially the rim 42 at the front side of the oven cavity 10. A rear side of the oven door 32 is aligned at the front side 44 of the front portion 36 of the gasket 30.

The front portion 36 of the gasket 30 comprises one or more electrically non-conductive materials, while the rear portion 38 of the gasket 30 comprises one or more electrically conductive materials. In general, the whole gasket 30 may be electrically conductive. At least that portion of the gasket 30 arranged within the gap 26 is preferably made of or includes electrically conductive material. It has been found that the front portion 36 of the gasket 30 does not require an electrically conductive component, if the wave choke system 34 is inside the oven door 32 and in front of the gap 26. The wave choke system 34 and the gap 26 between the oven cavity 10 and the front frame 20 shield substantially the whole microwave radiation, which could leak through the oven door 32 and/or between the front frame 20 and the oven door 32. This effect may be supported, if the elastic part for gasket 30 arranged in this area includes electrically conductive material. The elastic part for gasket 30 allows a compensation of tolerance between the front frame 20 and the oven door 32.

In general, the whole gasket 30 may be made of one or more elastic materials. However, at least that portion of the gasket 30 arranged between the front frame 20 and the inner side of the oven door 32 is preferably elastic. In contrast, that portion of the gasket 30 between the oven cavity 10 and the front frame 20 may be alternatively made of one or more inflexible materials. For example, one or more rigid materials are pressed in between the oven cavity 10 and the front frame 20.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 oven cavity
12 side wall
14 top wall
16 bottom wall
18 rear wall
20 front frame
22 lug
24 screw
26 gap
30 gasket
32 oven door
34 wave choke system
36 front portion of the gasket
38 rear portion of the gasket
40 hook
42 rim
44 front side of the front portion of the gasket

The invention claimed is:

1. A microwave oven or a multifunctional oven with microwave heating function, said oven comprising:

an oven cavity with side walls, a top wall and a bottom wall, an open front side, and a rim formed at the front side, a front frame enclosing at least partially a front portion of the oven cavity, a gap formed between front portions of the side walls, the top wall and the bottom wall of the oven cavity and the front frame, said gap enclosing at least partially the front portion of the oven cavity, the front frame enclosing the gap, a gasket arranged in direct contact with the front frame and the rim, said gasket at least partially filling the gap, and an oven door covering the open front side of the oven cavity and the gap in a closed state of said oven door, wherein the gasket includes a front portion comprised of a first material and a rear portion comprised of a second material, the front portion being positioned to fill the gap between the oven cavity and the front frame and forward of the rear portion with respect to the oven cavity.

2. The oven according to claim 1, wherein the front frame is connected to the oven cavity by a number of screws and/or rivets.

3. The oven according to claim 1, wherein the front frame comprises a number of lugs that align with cooperating lugs arranged on at least one of the side walls, the top wall and/or the bottom wall of the oven cavity.

4. The oven according to claim 3, wherein the screws penetrate the lugs.

5. The oven according to claim 1, wherein one of the first material and the second material comprises at least one elastic material.

6. The oven according to claim 1, wherein one of the first material and the second material comprises at least one electrically conductive material.

7. The oven according to claim 1, wherein the first material comprises at least one electrically non-conductive material, while the second material comprises at least one electrically conductive material.

8. The oven according to claim 1, wherein the gasket comprises one or more silicone materials.

9. The oven according to claim 7, wherein the second material comprises at least one silicone material containing small metallic particles mixed into said silicone materials.

10. The oven according to claim 7, wherein at least a part of the rear portion of the gasket fills the gap.

11. The oven according to claim 1, wherein the gasket is formed as a single-piece part.

12. The oven according to claim 1, wherein the oven door comprises a wave choke system extending in an outer portion of said oven door, so that the wave choke system is arranged in front of the gap, if the oven door is in the closed state.

13. The oven according to claim 7, wherein the rear portion of the gasket has an L-shaped cross section, wherein said L-shaped rear portion of the gasket encloses at least partially the rim at the front side of the oven cavity.

14. The oven according to claim 1, wherein the oven is a multifunctional oven with a microwave heating function and at least one further heating function.

15. The oven according to claim 3, wherein the lugs in the front frame align with the cooperating lugs arranged on each one of the side walls, the top wall and/or the bottom wall.

16. A microwave oven or a multifunctional oven with microwave heating function, said oven comprising:

an oven cavity with an open front side, a front frame enclosing at least partially a front portion of the oven cavity, the oven cavity and the front frame are made of metal sheet, the front frame is connected to the oven cavity by a number of fixing elements, a gap formed between the oven cavity and the front frame, said gap enclosing at least partially the front portion of the oven cavity, the front frame enclosing the gap, a gasket at least partially filling the gap, an oven door covering the open front side of the oven cavity and the gap in a closed state of said oven door, wherein:

at least a part of the gasket comprises one or more materials having low heat conductivity, so that the front frame is thermally decoupled from the oven cavity by said part of the gasket and/or by the gap, a front portion and a rear portion of the gasket comprise different materials, and the front portion comprises at least one electrically non-conductive material, while the rear portion comprises at least one electrically conductive material, the front portion being positioned to fill the gap between the oven cavity and the front frame and the rear portion partially enclosing a rim of the oven cavity.

17. The microwave oven or multifunctional oven with microwave heating function of claim 16, wherein the front portion of the gasket has a triangular cross section and the rear portion of the gasket has an L-shaped cross section.

* * * * *